US008262422B1

(12) United States Patent
Chiang

(10) Patent No.: US 8,262,422 B1
(45) Date of Patent: Sep. 11, 2012

(54) ELECTRICAL CONNECTOR

(75) Inventor: Chih-Hsien Chiang, New Taipei (TW)

(73) Assignee: Cheng Uei Precision Industry Co., Ltd., New Taipei (TW)

( * ) Notice: Subject to any disclaimer, the term of this patent is extended or adjusted under 35 U.S.C. 154(b) by 0 days.

(21) Appl. No.: 13/193,601

(22) Filed: Jul. 28, 2011

(51) Int. Cl.
*H01R 4/48* (2006.01)

(52) U.S. Cl. ..... 439/835; 439/441

(58) Field of Classification Search ..... 439/436, 439/441, 625, 729, 834, 835
See application file for complete search history.

(56) References Cited

U.S. PATENT DOCUMENTS 4,759,726 A * 7/1988 Naylor et al. ..... 439/441
6,350,162 B1 * 2/2002 Despang ..... 439/835
6,851,967 B2 * 2/2005 Miyoshi et al. ..... 439/441
7,607,956 B2 * 10/2009 Lang et al. ..... 439/835
7,618,279 B1 * 11/2009 Osborn et al. ..... 439/441
7,625,253 B2 * 12/2009 Eppe et al. ..... 439/835
8,062,079 B2 * 11/2011 Hoppmann ..... 439/834
8,113,858 B1 * 2/2012 Chiang ..... 439/188
2011/0318972 A1 * 12/2011 Koellmann ..... 439/729

* cited by examiner

*Primary Examiner* — James Harvey
(74) *Attorney, Agent, or Firm* — Cheng-Ju Chiang

(57) ABSTRACT

An electrical connector includes an insulating housing having a protrusion with a pivot pillar at a top thereof. A connecting terminal is positioned in the insulating housing and has a base plate, a connecting plate, a side plate and a clipping piece slantwise extending inward from a rear edge of the connecting plate. A clipping terminal has a resisting board against the side plate, a clipping board inclined towards the clipping piece and a bend portion connecting the resisting board and the clipping board to be put around the protrusion. A rear edge of the clipping board slantwise extends inward to form a resisting arm having a buckling block at a top thereof. A whirling element is pivoted to the pivot pillar and defining a buckling hole for buckling the buckling block. The rotation of the whirling element drives the clipping board to secure or set free a cable.

5 Claims, 4 Drawing Sheets

ELECTRICAL CONNECTOR

BACKGROUND OF THE INVENTION

1. Field of the Invention

The present invention generally relates to an electrical connector, and more particularly to an electrical connector capable of connecting with a cable.

2. The Related Art

A conventional electrical connector adapted for connecting a cable with a printed circuit board includes an insulating housing, an assistant terminal and a conductive terminal which are assembled in the insulating housing and electrically connect with each other. The conductive terminal is adapted to be soldered with the printed circuit board. The assistant terminal has a connecting portion with a wedging hole being opened therein. When the cable need be connected to the electrical connector, a conductive core of one end of the cable is inserted into the wedging hole of the connecting portion of the assistant terminal. Then the conductive core is further soldered together with the connecting portion of the assistant terminal. So, an electrical connection is realized between the cable and the printed circuit board by means of the electrical connector. However, the foregoing connection operation between the assistant terminal and the cable not only is complex, but also wastes working time.

SUMMARY OF THE INVENTION

An object of the present invention is to provide an electrical connector for connecting with a cable. The electrical connector includes an insulating housing defining an accommodating space which is surrounded among a bottom wall, a front wall, a rear wall and two side walls. A front of the bottom wall protrudes upward into the accommodating space to form a protrusion, and a pivot pillar is further protruded upward from a top of the protrusion. A connecting terminal is positioned in the accommodating space and has a base plate against the bottom wall. Two opposite side edges of the base plate extend upward to form a connecting plate at a front thereof and a side plate which abut against the side walls respectively. A clipping piece is connected with a rear edge of the connecting plate and freely inclined towards the side plate. A clipping terminal is positioned in the accommodating space and has a resisting board vertically abutting against an inside of the side plate to realize an electrical connection with the connecting terminal. A bend portion is bent towards the resisting board from a front edge of the resisting board and put around the protrusion. A rear edge of the bend portion extends rearward and is inclined oppositely to the resisting board to form a clipping board of which a rear edge is substantially against an inside of the clipping piece. A top of the rear edge of the clipping board slantwise extends towards the resisting board to form a resisting arm having a buckling block protruded at a top edge thereof. A whirling element is rotatably pivoted to the pivot pillar, and has a pushing board defining a buckling hole for buckling the buckling block therein. A pushing portion is formed at a rear of the pushing board and located behind the rear wall for being pushed to drive the whirling element to rotate so as to further depart the clipping board from the clipping piece by means of the cooperation of the buckling block and the buckling hole for the convenience of insertion and extraction of the cable passing through the front wall between the clipping board and the clipping piece.

As described above, when the cable need be connected with the electrical connector, the rotation of the whirling element can drive the clipping board of the clipping terminal to depart from the clipping piece of the connecting terminal for the convenience of the insertion of the cable between the clipping board and the clipping piece. Then, set free the whirling element to firmly clip one end of the cable between rear edges of the clipping board and the clipping piece by means of the restoring resilience of the bend portion. So a simple connection operation is realized between the cable and the electrical connector.

BRIEF DESCRIPTION OF THE DRAWINGS

The present invention will be apparent to those skilled in the art by reading the following description, with reference to the attached drawings, in which.

DETAILED DESCRIPTION OF THE PREFERRED EMBODIMENT

Figure 1:
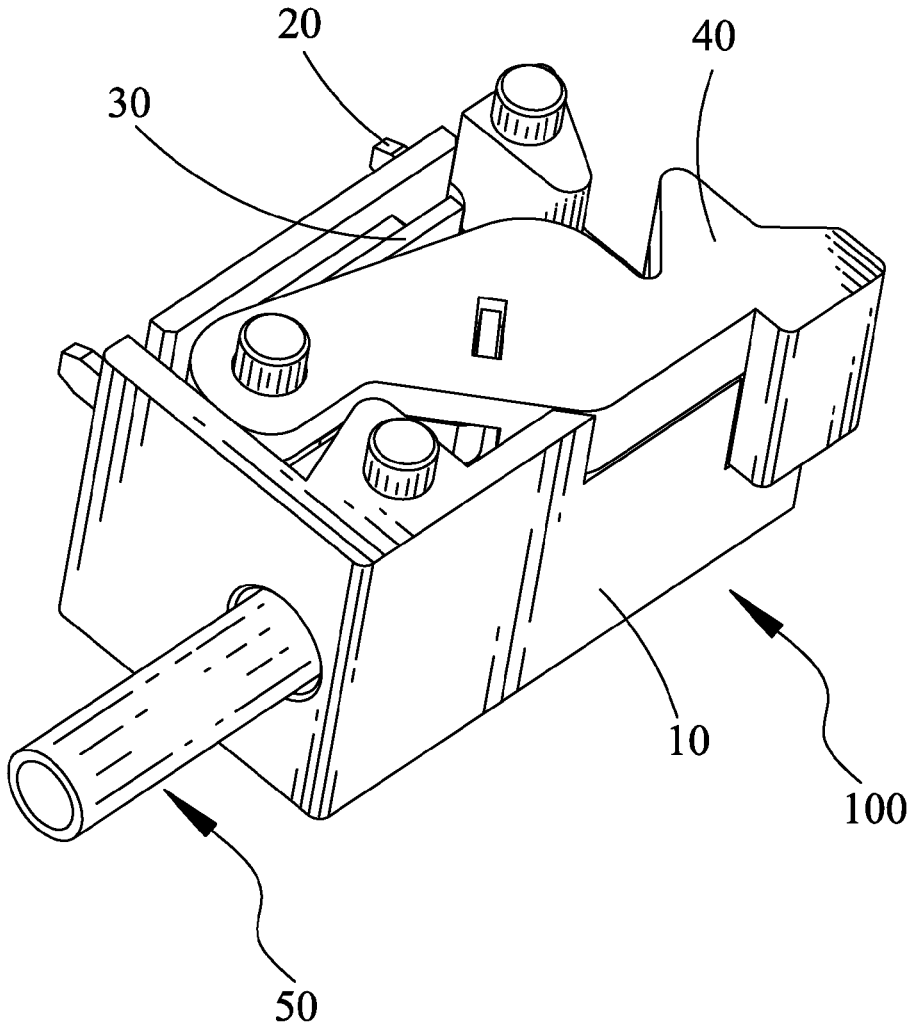
FIG. 1 is an assembled perspective view of an electrical connector in accordance with an embodiment of the present invention, wherein a cable is assembled to the electrical connector.

With reference to FIG. 1, an electrical connector 100 in accordance with an embodiment of the present invention is shown. The electrical connector 100 is adapted for connecting a cable 50 with a printed circuit board (not shown). The electrical connector 100 includes an insulating housing 10, a connecting terminal 20, a clipping terminal 30 and a whirling element 40.

Figure 2:
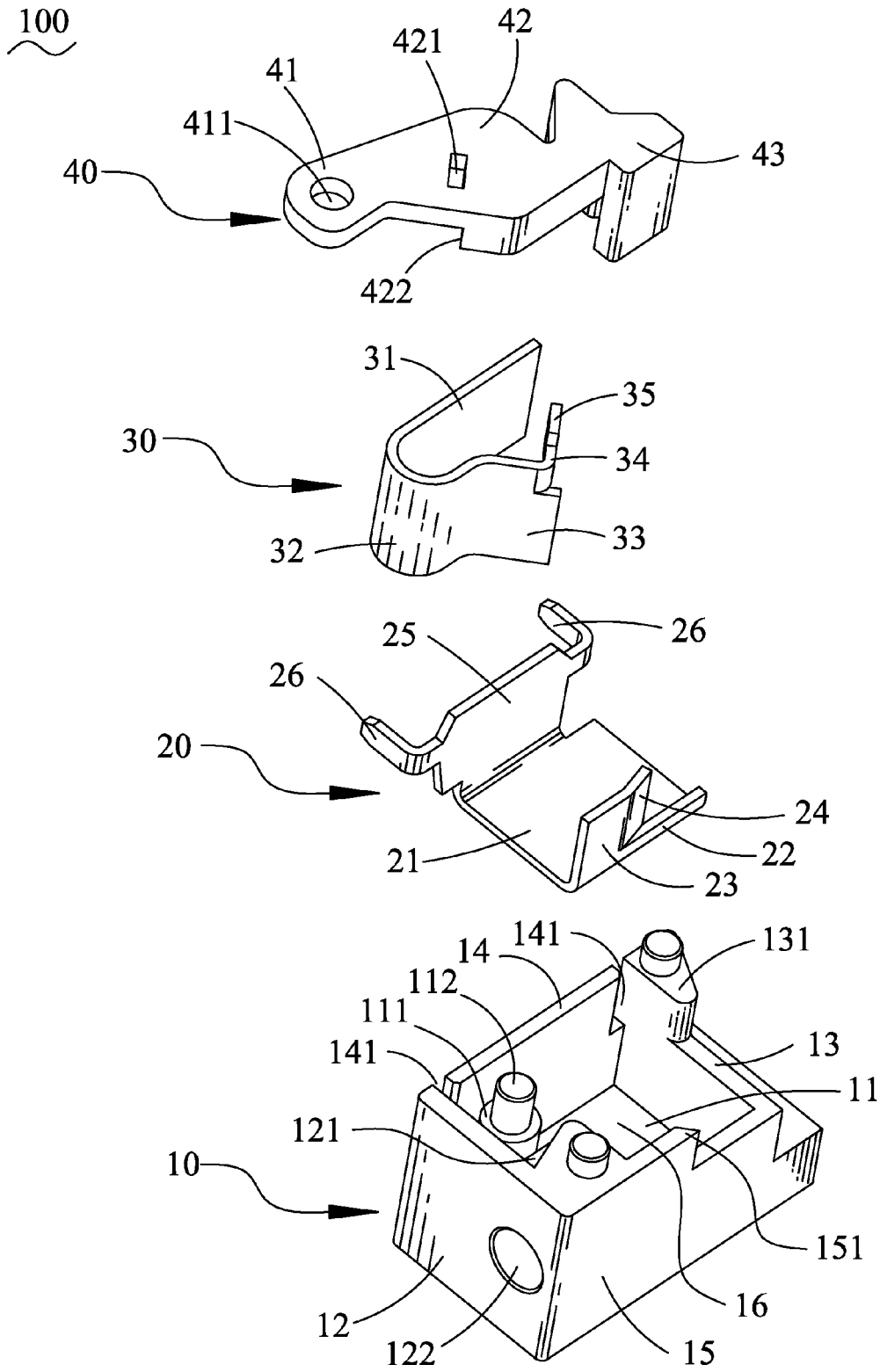
FIG. 2 is an exploded perspective view of the electrical connector of FIG. 1.

Referring to FIG. 2, the insulating housing 10 has a bottom wall 11 of a rectangular shape, a front wall 12, a rear wall 13, a first side wall 14 and a second side wall 15 which are connected together to define an accommodating space 16 thereamong. An inside of the front wall 12 protrudes rearward to form a restraining block 121 adjacent to the second side wall 15. An inserting hole 122 penetrates through the restraining block 121 and the front wall 12 along a front-to-rear direction to be communicated with the accommodating space 16. A front of a top side of the bottom wall 11 protrudes upward to form a cylindrical protrusion 111 apart located between the restraining block 121 and the first side wall 14. A pivot pillar 112 protrudes upward from a middle of a top of the protrusion 111 and has a smaller diameter than the one of the protrusion 111. A top of the rear wall 13 protrudes upward to form a triangle-shaped blocking block 131 adjacent to the first side wall 14. Two slots 141 are opened in a front end and a rear end of a top of the first side wall 14 and further penetrate through two opposite sides of the first side wall 14, respectively. A front end of a top of the second side wall 15 protrudes upward to form a blocking portion 151 adjacent to the front wall 12.

The connecting terminal 20 has a rectangular base plate 21 of which one side edge is bent upward to form an eave 22 and the other side edge extends upward to form a side plate 25. Tops of a front edge and a rear edge of the side plate 25 extend sideward and oppositely to the eave 22 to form a pair of soldering tails 26. A front of a top of the eave 22 protrudes upward to form a connecting plate 23, and a clipping piece 24 is connected with a rear edge of the connecting plate 23 and freely inclined towards the side plate 25.

The clipping terminal 30 has a vertical resisting board 31, a bend portion 32 bent towards the resisting board 31 from a front edge of the resisting board 31, and a clipping board 33 which extends rearward from a rear edge of the bend portion 32 and is inclined oppositely to the resisting board 31 in process of extending rearward. A top of a rear edge of the clipping board 33 slantwise extends towards the resisting board 31 to form a resisting arm 34 with a buckling block 35 being protruded upward at a top edge thereof.

Figure 3:
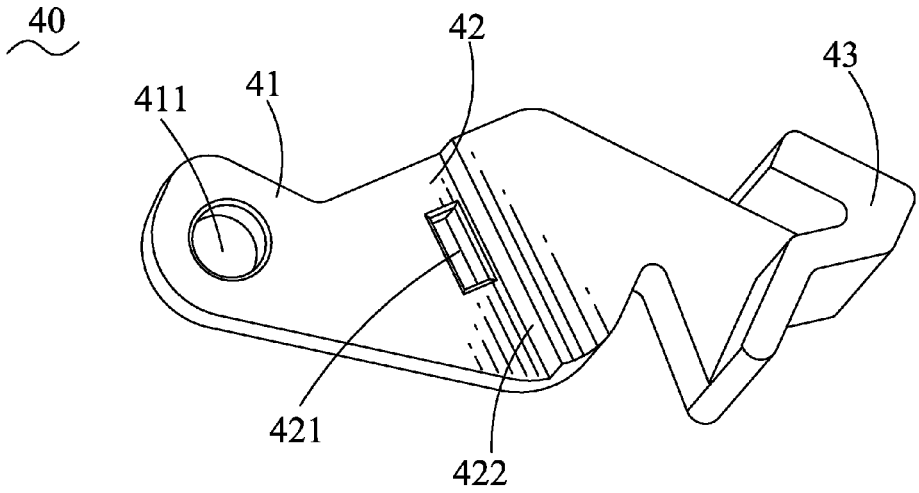
FIG. 3 is a perspective view of a whirling element of the electrical connector of FIG. 1.

Referring to FIG. 2 and FIG. 3, the whirling element 40 is made of insulative material and has a pushing board 42. A side of a front edge of the pushing board 42 extends forward to form a pivot ear 41 where a pivot hole 411 is opened. A pushing portion 43 is formed at a rear of the pushing board 42. The pushing board 42 defines a buckling hole 421 vertically penetrating therethrough, and a resisting step 422 protruded at a bottom thereof and adjacent to the buckling hole 421, wherein the resisting step 422 is designed in accordance with the resisting arm 34 of the clipping terminal 30 so as to abut against an outside of the resisting arm 34 opposite to the resisting board 31 after the electrical connector 100 is assembled completely.

Figure 4:
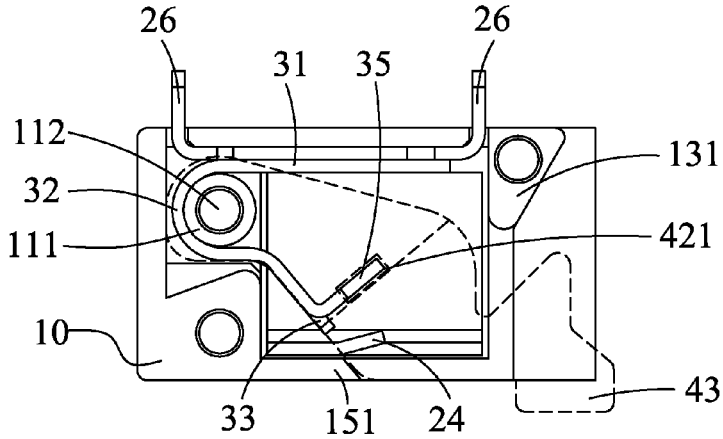
FIG. 4 is a vertical view of the electrical connector of FIG. 1, wherein the whirling element is excluded and drawn in dotted line in order to show other structures of the electrical connector.

Referring to FIG. 1, FIG. 2 and FIG. 4, in assembly, the connecting terminal 20 is positioned in the accommodating space 16 of the insulating housing 10, with the base plate 21 abutting against the top side of the bottom wall 11, the side plate 25 abutting against an inside of the first side wall 14, and the eave 22 and the connecting plate 23 abutting against an inside of the second side wall 15. The soldering tails 26 pass through the corresponding slots 141 to stretch out of the insulating housing 10 so as to be soldered with the printed circuit board. Then, the clipping terminal 30 is positioned in the accommodating space 16 against a top side of the base plate 21, with the protrusion 111 being inserted in the bend portion 32, the resisting board 31 abutting against an inside of the side plate 25 to realize an electrical connection between the clipping terminal 30 and the connecting terminal 20, and the rear edge of the clipping board 33 being substantially against an inside of the clipping piece 24. Then, the whirling element 40 is rotatably pivoted to the insulating housing 10 by means of the pivot pillar 112 being inserted in the pivot hole 411. The buckling block 35 of the clipping terminal 30 is buckled in the buckling hole 421 and the resisting step 422 abuts against the outside of the resisting arm 34. The front edge of the pushing board 42 is against the blocking portion 151, and at this state, the pushing board 42 is apart from the blocking block 131. The pushing portion 43 is positioned behind the rear wall 13.

Figure 5:
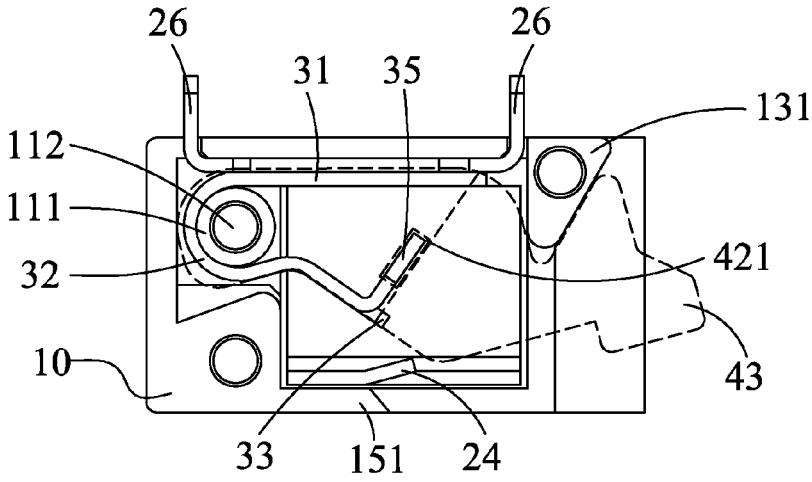
FIG. 5 is a vertical view showing another state of the electrical connector of FIG. 1.
Figure 6:
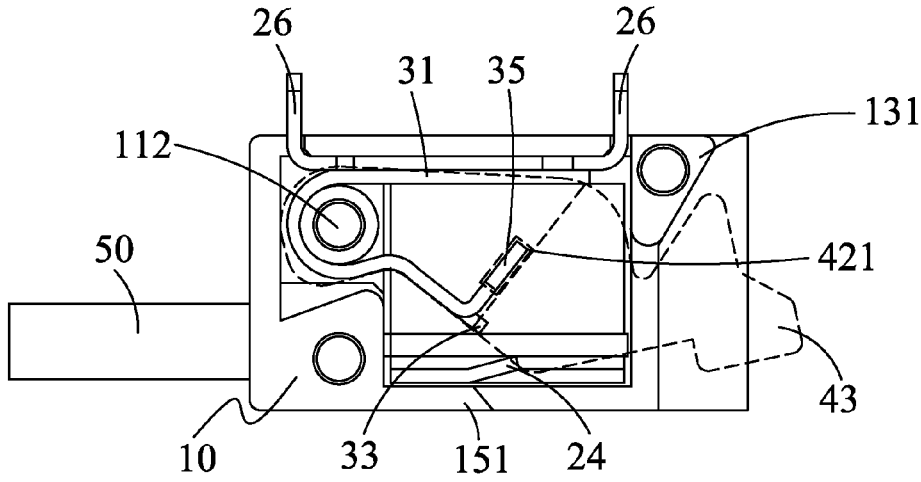
FIG. 6 is a vertical view of the electrical connector of FIG. 1, wherein the cable is assembled to the electrical connector firmly, the whirling element is excluded and drawn in dotted line in order to show other structures of the electrical connector.

Referring to FIG. 4, FIG. 5 and FIG. 6, in use, push the pushing portion 43 to drive the whirling element 40 to depart from the blocking portion 151 and rotate towards the blocking block 131. In the process of the whirling element 40 rotating, the resisting step 422 further drives the resisting arm 34 to move towards the resisting board 31 by the cooperation of the buckling hole 421 and the buckling block 35, until the pushing board 42 of the whirling element 40 is blocked by the blocking block 131. At this time, there is an interval formed between the clipping board 33 of the clipping terminal 30 and the clipping piece 24 of the connecting terminal 20 for the convenience of insertion and extraction of the cable 50. After one end of the cable 50 passes through the inserting hole 122 of the insulating housing 10 to be positioned between the clipping board 33 and the clipping piece 24, set free the pushing portion 43 so as to firmly clip the one end of the cable 50 between rear edges of the clipping board 33 and the clipping piece 24 by means of the restoring resilience of the bend portion 32. In this embodiment, the restraining block 121 of the insulating housing 10 can make the bend portion 32 of the clipping terminal 30 steadily put around the protrusion 111, and further prevent the clipping board 33 from excessively rebounding.

As described above, when the cable 50 need be connected with the electrical connector 100, the rotation of the whirling element 40 can drive the clipping board 33 of the clipping terminal 30 to depart from the clipping piece 24 of the connecting terminal 20 for the convenience of the insertion of the cable 50 between the clipping board 33 and the clipping piece 24. Then, set free the whirling element 40 to firmly clip the one end of the cable 50 between the rear edges of the clipping board 33 and the clipping piece 24 by means of the restoring resilience of the bend portion 32. So a simple connection operation is realized between the cable 50 and the electrical connector 100.

What is claimed is:

1. An electrical connector for connecting with a cable, comprising:

an insulating housing defining an accommodating space surrounded among a bottom wall, a front wall, a rear wall and two side walls, a front of the bottom wall protruding upward into the accommodating space to form a protrusion, a pivot pillar being further protruded upward from a top of the protrusion;

a connecting terminal positioned in the accommodating space and having a base plate against the bottom wall, two opposite side edges of the base plate extending upward to form a connecting plate at a front thereof and a side plate which abut against the side walls respectively, a clipping piece being connected with a rear edge of the connecting plate and freely inclined towards the side plate;

a clipping terminal positioned in the accommodating space and having a resisting board vertically abutting against an inside of the side plate to realize an electrical connection with the connecting terminal, a bend portion being bent towards the resisting board from a front edge of the resisting board and put around the protrusion, a rear edge of the bend portion extending rearward and being inclined oppositely to the resisting board to form a clipping board of which a rear edge is substantially against an inside of the clipping piece, a top of the rear edge of the clipping board slantwise extending towards the resisting board to form a resisting arm having a buckling block protruded at a top edge thereof; and a whirling element rotatably pivoted to the pivot pillar, and having a pushing board defining a buckling hole for buckling the buckling block therein, a pushing portion being formed at a rear of the pushing board and located behind the rear wall for being pushed to drive the whirling element to rotate so as to further depart the clipping board from the clipping piece by means of the cooperation of the buckling block and the buckling hole for the convenience of insertion and extraction of the cable passing through the front wall between the clipping board and the clipping piece.

2. The electrical connector as claimed in claim 1, wherein a resisting step is protruded at a bottom of the pushing board for resisting against an outside of the resisting arm.

3. The electrical connector as claimed in claim 1, wherein a side of a front edge of the pushing board extends forward to form a pivot ear where a pivot hole is opened, the pivot pillar is inserted in the pivot hole.

4. The electrical connector as claimed in claim 1, wherein two opposite edges of the side plate of the connecting terminal extend outward to form two soldering tails passing through the corresponding side wall to stretch out of the insulating housing for electrically connecting with a printed circuit board.

5. The electrical connector as claimed in claim 1, wherein a top of the rear wall protrudes upward to form a blocking block adjacent to the resisting board, a front end of a top of the side wall adjacent to the connecting plate protrudes upward to form a blocking portion, the whirling element is rotatably restrained between the blocking portion and the blocking block.

* * * * *